US012270254B2

(12) United States Patent
Mumma et al.

(10) Patent No.: US 12,270,254 B2
(45) Date of Patent: Apr. 8, 2025

(54) DRILL BITS WITH VARIABLE CUTTER ALIGNMENT

(71) Applicant: Taurex Drill Bits, LLC, Norman, OK (US)

(72) Inventors: Matthew Mumma, Oklahoma City, OK (US); Ryan Matthews, Powderly, TX (US); Brandon Sheldon, Houston, TX (US); Eric Walter Sonne, Colorado City, TX (US)

(73) Assignee: Taurex Drill Bits, LLC, Norman, OK (US)

( * ) Notice: Subject to any disclaimer, the term of this patent is extended or adjusted under 35 U.S.C. 154(b) by 166 days.

(21) Appl. No.: 17/503,687

(22) Filed: Oct. 18, 2021

(65) Prior Publication Data

US 2022/0120140 A1 Apr. 21, 2022

Related U.S. Application Data

(60) Provisional application No. 63/093,377, filed on Oct. 19, 2020.

(51) Int. Cl.
*E21B 10/43* (2006.01)
*E21B 10/55* (2006.01)
*E21B 10/60* (2006.01)

(52) U.S. Cl.
CPC ..... *E21B 10/43* (2013.01); *E21B 10/55* (2013.01); *E21B 10/602* (2013.01)

(58) Field of Classification Search
CPC ..... E21B 10/43; E21B 10/55
See application file for complete search history.

(56) References Cited

U.S. PATENT DOCUMENTS 4,471,845 A * 9/1984 Jurgens ..... E21B 10/43 175/431
4,848,489 A * 7/1989 Deane ..... E21B 10/602 175/429
5,244,039 A * 9/1993 Newton, Jr. ..... E21B 10/567 175/431
5,265,685 A * 11/1993 Keith ..... E21B 10/43 175/431
5,531,281 A * 7/1996 Murdock ..... E21B 10/43 175/431
5,582,261 A * 12/1996 Keith ..... E21B 10/43 175/434
6,196,340 B1 * 3/2001 Jensen ..... E21B 10/52 175/431
7,703,557 B2 * 4/2010 Durairajan ..... E21B 10/43 175/426
8,020,639 B2 9/2011 Wells et al.
(Continued)

FOREIGN PATENT DOCUMENTS

CN 111322015 A * 6/2020

*Primary Examiner* — Blake Michener
(74) *Attorney, Agent, or Firm* — Vorys, Sater, Seymour and Pease LLP

(57) ABSTRACT

A drill bit includes a bit body providing a plurality of blades disposed about a centerline of the bit body, one or more primary cutters mounted at a leading face of each blade, and one or more offset cutters mounted to at least one of the plurality of blades and angularly offset from a laterally adjacent primary cutter and the leading face of the at least one of the plurality of blades.

17 Claims, 5 Drawing Sheets

(56) References Cited

U.S. PATENT DOCUMENTS

| | | | | |
|---|---|---|---|---|
| 8,950,514 | B2 * | 2/2015 | Buske | E21B 10/14 175/336 |
| 2008/0314647 | A1 * | 12/2008 | Hall | E21B 10/42 175/430 |
| 2010/0018780 | A1 | 1/2010 | Johnson et al. | |
| 2011/0155472 | A1 * | 6/2011 | Lyons | E21B 10/55 76/108.1 |
| 2015/0368979 | A1 | 12/2015 | Casad | |
| 2016/0376847 | A1 * | 12/2016 | Matthews | E21B 10/43 175/430 |

* cited by examiner

DRILL BITS WITH VARIABLE CUTTER ALIGNMENT

BACKGROUND

In the oil and gas industry, drill bits are commonly used to drill wellbores or boreholes. To accomplish this, a drill bit is attached to the end of a string of drill pipe (i.e., a "drill string") and rotated to grind and cut through the underlying rock and subterranean formations of the earth. As the drill bit advances into the earth, a drilling fluid is typically pumped down the drill string and discharged at the drill bit to cool and lubricate the drill bit and also help carry fragments or cuttings removed by the drill bit up the annulus and out of the wellbore.

Drag bits or "fixed cutter" bits are one type of drill bit that typically include a body with a plurality of blades extending from the body. Drag bits typically have no moving parts and are cast or milled as a single-piece body with cutting elements or "cutters" brazed into the blades of the body. Each blade supports a plurality of discrete cutters typically made of a variety of hard or ultra-hard materials, such as polycrystalline diamond (PCD). The cutters are strategically positioned on the bit body to optimize performance and durability.

As the drill bit rotates during operation, the cutters mounted on the blades sweep a radial path in the borehole, and thereby contact, shear, crush, and fail rock. The failed material passes into channels or "junk slots" defined between the bit blades and is flushed to the surface by the circulating drilling fluid discharged from the drill bit.

The drill bit often penetrates various subterranean materials that have a tendency of clogging the junk slots and thereby reducing the rate of penetration. Some materials, for instance, can quickly absorb fluid and form a sticky clay that forms ribbons as it is cut from the borehole. The ribbons can agglomerate and cling to the surface of the drill bit within the junk slots, which narrows the dimensions of the junk slots and thereby limits the volume of material that can be efficiently processed (flushed) therethrough. This can also cause the drill bit to bog down and underperform.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

The present disclosure is related to drill bits and, more particularly, to varying the alignment of cutters mounted to drill bit blades.

Embodiments disclosed herein describe drill bits that have fixed cutters with independently adjusted angular distances between laterally adjacent cutters mounted to a common blade. In some embodiments, for example, a cutter can be angularly offset (either backward or forward) from a laterally adjacent cutter or the leading face of a blade. Consequently, one or more of the laterally adjacent cutters may be leading or trailing the angularly offset cutter on the same blade. Angularly offsetting one or more cutters along the arcuate length of a blade can provide several benefits, including reduced wear, reduced work rate spikes, and increased stability.

Embodiments disclosed herein also describe drill bits that have fixed cutters with independently adjusted angular distances between radially adjacent cutters mounted to discrete blades. In some embodiments, for example, a primary cutter can be mounted to a first blade and at the leading face of the first blade, and an offset cutter may be mounted to a second blade and radially adjacent to the primary cutter on the first blade. In such embodiments, the offset cutter may be angularly offset from a leading face of the second blade. The offset cutter may comprise a recessed cutter positioned angularly behind the leading face of the second blade, or may alternatively comprise an advanced cutter positioned angularly in front of the leading face of the second blade.

Figure 1:
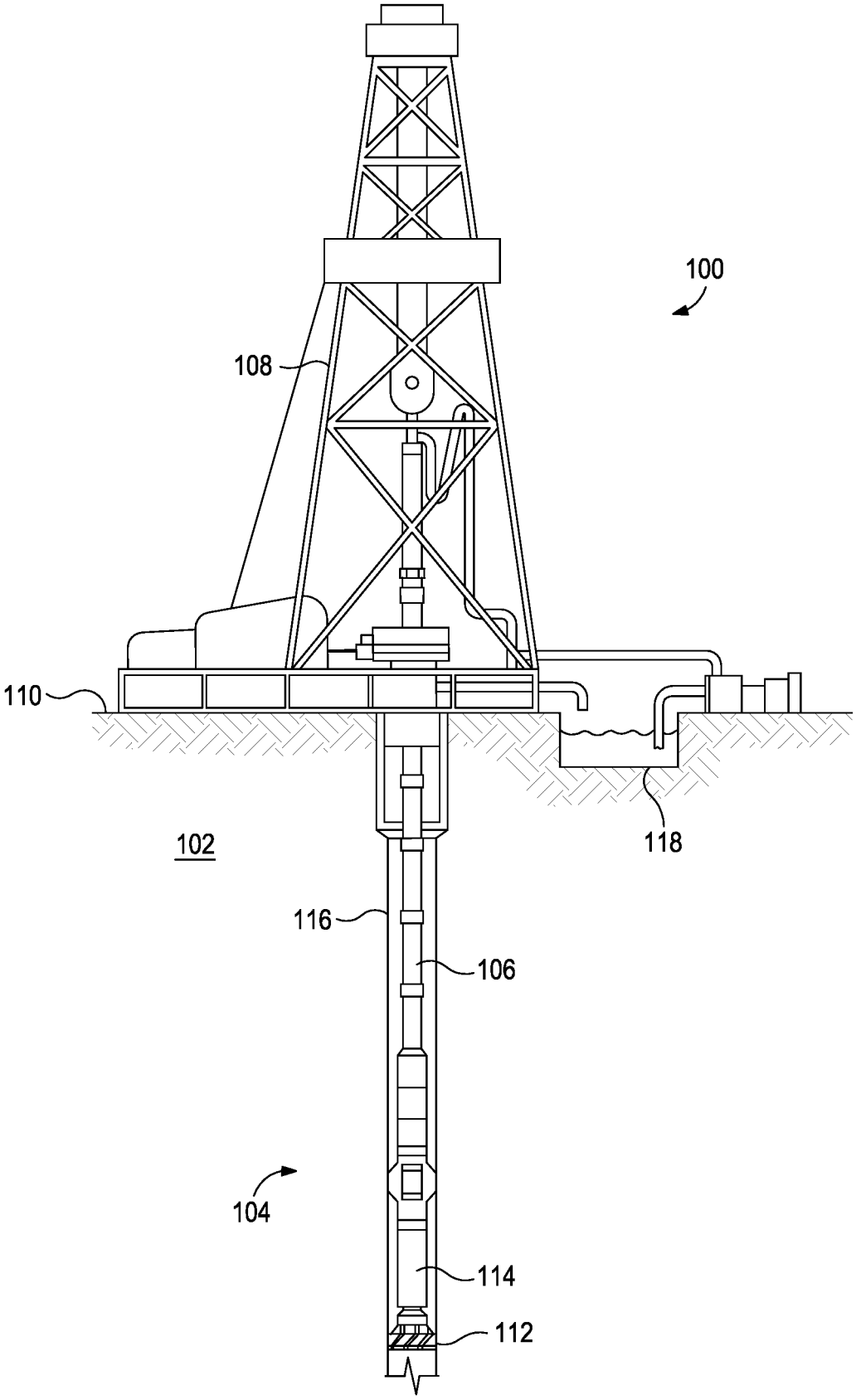
FIG. 1 is a schematic diagram of an example drilling system that may employ one or more principles of the present disclosure.

FIG. 1 is a schematic diagram of an example drilling system 100 that may incorporate one or more principles of the present disclosure. Boreholes may be created by drilling into the earth 102 using the drilling system 100. To accomplish this, the drilling system 100 may be configured to drive a bottom hole assembly (BHA) 104 positioned or otherwise arranged at the bottom of a drill string 106 extended into the earth 102 from a derrick 108 arranged at the surface 110. The derrick 108 includes various mechanisms operable to lower and raise the drill string 106.

The BHA 104 includes a drill bit 112 operatively coupled to a tool string 114 which is moved axially within a drilled wellbore 116 as attached to the drill string 106. The depth (length) of the wellbore 116 is extended by rotating the drill bit 112, which grinds and cuts through the underlying rock and subterranean formations of the earth 102. During drilling operations, a drilling fluid or "mud" from a mud tank 118 may be pumped into the drill string 106 and conveyed downhole to the drill bit 112. Upon reaching the drill bit 112, the mud is discharged through various nozzles included in the drill bit 112 to cool and lubricate the drill bit 112. The mud then circulates back to the surface 110 via the annulus defined between the wellbore 116 and the drill string 106, and in the process returns drill cuttings and debris to the surface. The cuttings and mud mixture are processed and returned to the mud tank 118 to be subsequently conveyed downhole once again.

Figure 2:
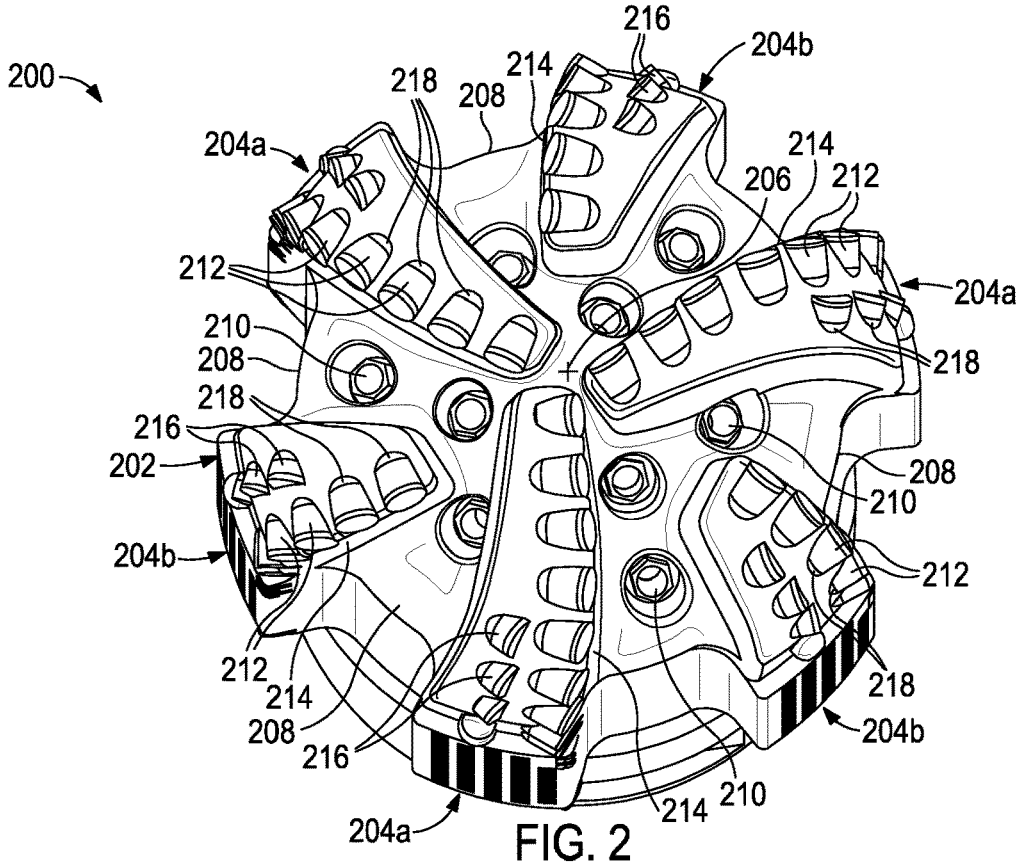
FIG. 2 (PRIOR ART)
FIG. 2 is an isometric top view of a prior art drill bit.

FIG. 2 is an isometric top view of a prior art drill bit 200. The drill bit 200 may be the same as or similar to the drill bit 112 of FIG. 1 and, therefore, could be used in the drilling system 100 to drill the wellbore 116. The drill bit 200 includes a bit body 202 that provides a plurality of drill bit blades, shown as a plurality of primary blades 204*a* and one or more secondary blades 204*b* interposing angularly adjacent primary blades 204*a*. As used herein, the term "angularly adjacent" refers to the relative position of two objects about the circumference or outer perimeter of a common body. Here, the primary and secondary blades 204*a,b* are considered angularly adjacent since they are positioned angularly offset (in a direction of rotation) from each other about the circumference of the bit body 202.

The primary and secondary blades 204*a,b* are disposed about a bit rotational axis or "centerline" 206. The number and location of the primary and secondary blades 204*a,b* can vary and can be disposed symmetrically or asymmetrically about the centerline 206 and/or with respect to one another.

The primary and secondary blades 204*a,b* are separated by junk slots 208. In the illustrated example, the blades 204*a,b* and the junk slots 208 do not extend to the centerline 206, but could alternatively extend to the centerline 206, without departing from the scope of the disclosure. One or more nozzles 210 are arranged within each junk slot 208 and provide locations where drilling fluid or "mud" can be discharged from the drill bit 200 during operation.

The bit body 202 can be formed integrally with the blades 204*a,b*, such as being milled out of a steel blank. Alternatively, the blades 204*a,b* can be welded to the bit body 202. In other embodiments, the bit body 202 and the blades 204*a,b* may be formed of a matrix material sintered in a mold of a desired shape, typically a tungsten carbide matrix with an alloy binder, with the blades 204*a,b* also being integrally formed of the matrix with the bit body 202.

The drill bit 200 also includes one or more primary cutting elements or "cutters" 212 mounted to each blade 204*a,b*, and generally one or more "back-up" cutters 216 mounted to each blade 204*a,b*. Each cutter 212, 216 may be received within and bonded to a dedicated cutter pocket 218 that is machined or cast into the bit body 202 at the corresponding blade 204*a,b*. Each back-up cutter 216 is positioned to angularly trail at least one of the primary cutting elements 212 as the drill bit 200 rotates about the centerline 206. The back-up cutters 216 are normally positioned below the profile of the primary cutters 212 so that they are not actively cutting rock unless the depth-of-cut is greater than expected or the primary cutter 212 in front fails or is damaged.

The cutters 212, 216 may include a cutting table or face bonded to a substrate. The cutting face may be made of a variety of hard or ultra-hard materials such as, but not limited to, polycrystalline diamond (PCD), sintered tungsten carbide, thermally stable polycrystalline (TSP), polycrystalline boron nitride, cubic boron nitride, natural or synthetic diamond, hardened steel, or any combination thereof. The substrate may also be made of a hard material, such as tungsten carbide or ceramic. In other embodiments, however, one or more of the cutters 212, 216 may not incorporate a cutting table. In such embodiments, the cutters 212, 216 may comprise sintered tungsten carbide inserts without a cutting table and bonded to corresponding cutter pockets 218.

The primary cutters 212 are generally mounted to the corresponding blade 204*a,b* at a leading face 214 (alternately referred to as a "blade face") of each blade 204*a,b*. More specifically, the primary cutters 212 are generally positioned such that the cutting face of a given cutter 212 is arranged flush with the leading face 214 of each blade 204*a,b* which generally follows a smooth, uninterrupted, straight or curved line extending from the centerline 206. The back-up cutters 216 are angularly offset from the primary cutters 212 on the same blade 204*a,b* and generally positioned such that they trail the primary cutters 212 on the corresponding blade 204*a,b* as the drill bit 200 rotates about the centerline 206. Accordingly, the leading faces 214 of each blade 204*a,b* in the drill bit 200 may generally define smooth or uninterrupted surfaces.

Figure 3:
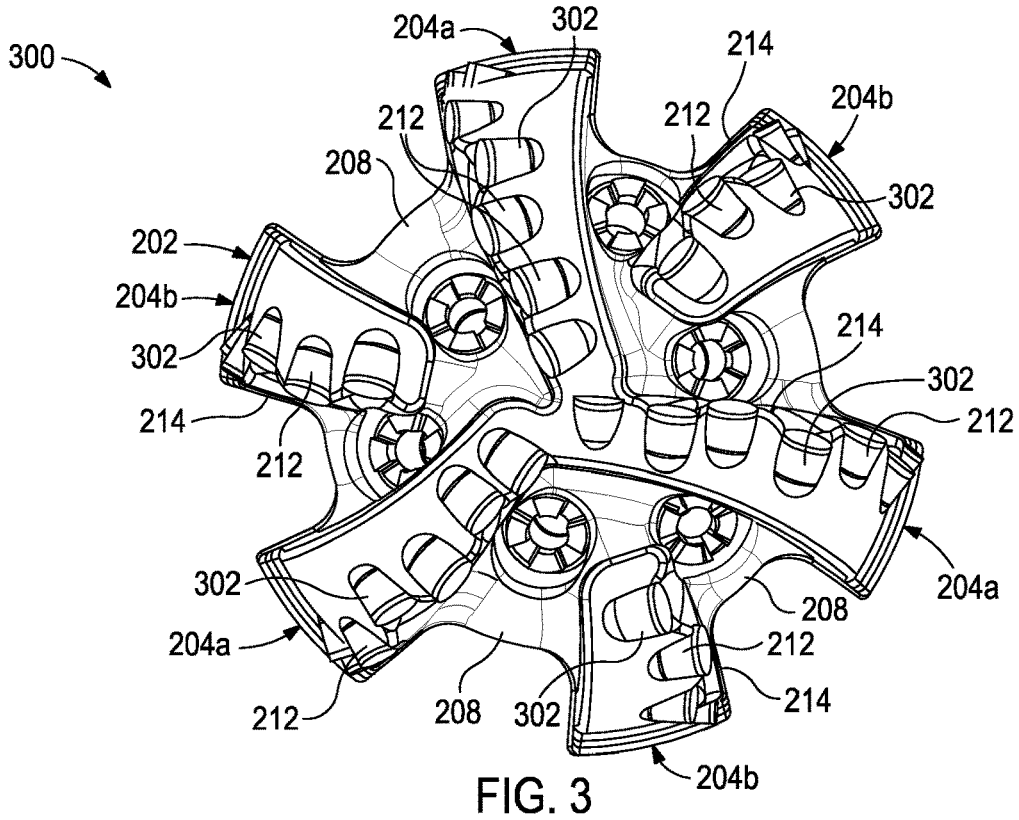
FIG. 3 is a top view of an example drill bit that may incorporate the principles of the present disclosure.

FIG. 3 is a top view of an example drill bit 300 that may incorporate the principles of the present disclosure. The drill bit 300 may be similar in some respects to the drill bit 200 of FIG. 2, and therefore may be best understood with reference thereto, where like numerals correspond to like components not described again. Similar to the drill bit 200, for example, the drill bit 300 can be used in connection with the drilling system 100 of FIG. 1 to drill a wellbore 116. Moreover, the drill bit 300 includes the bit body 202, which includes the primary and secondary blades 204*a,b* separated by the junk slots 208. In at least one embodiment, however, the secondary blade(s) 204*b* may be omitted, without departing from the scope of the disclosure. The drill bit 300 may further include the primary cutters 212 arranged on each blade 204*a,b*. While not shown in FIG. 3, in some embodiments, the drill bit 300 may include one or more back-up cutters 216 (FIG. 2) arranged on one or more of the blades 204*a,b* and trailing the primary cutters 212, as generally described above.

Unlike the drill bit 200 of FIG. 2, however, the drill bit 300 may include one or more offset cutters that are angularly offset from laterally adjacent primary cutters 212 positioned on the same primary blade 204*a*. More specifically, in some embodiments, the drill bit 300 may include one or more recessed offset cutters 302 mounted to the primary blades 204*a*. Each recessed offset cutter 302 may be angularly offset from an adjacent primary cutter 212 positioned on the same primary blade 204*a*. As illustrated, each recessed offset cutter 302 may be arranged angularly behind (e.g., in the direction of bit rotation) laterally adjacent primary cutters 212 and offset from the leading face 214 of the primary blade 204*a*. Consequently, the cutting faces of the recessed offset cutters 302 may not align with the cutting faces of laterally adjacent primary cutters 212 along the leading face 214 of the primary blade 204. Rather, the cutting faces of the recessed offset cutters 302 are angularly offset from the cutting faces of laterally adjacent primary cutters 212.

While not shown in FIG. 3, in embodiments where the drill bit 300 includes back-up cutters, the drill bit 300 may further include one or more offset cutters that are angularly offset from laterally adjacent back-up cutters positioned on one or more of the blades 204*a,b*. More specifically, in some embodiments, the drill bit 300 may include one or more recessed back-up cutters mounted to one or more of the blades 204*a,b*, and each recessed back-up cutter may be angularly offset from a laterally adjacent back-up cutter positioned on the same blade 204*a,b*. Consequently, the cutting faces of the recessed offset cutter may not align with the cutting faces of laterally adjacent back-up cutters on the same blade 204*a,b*.

Figure 4:
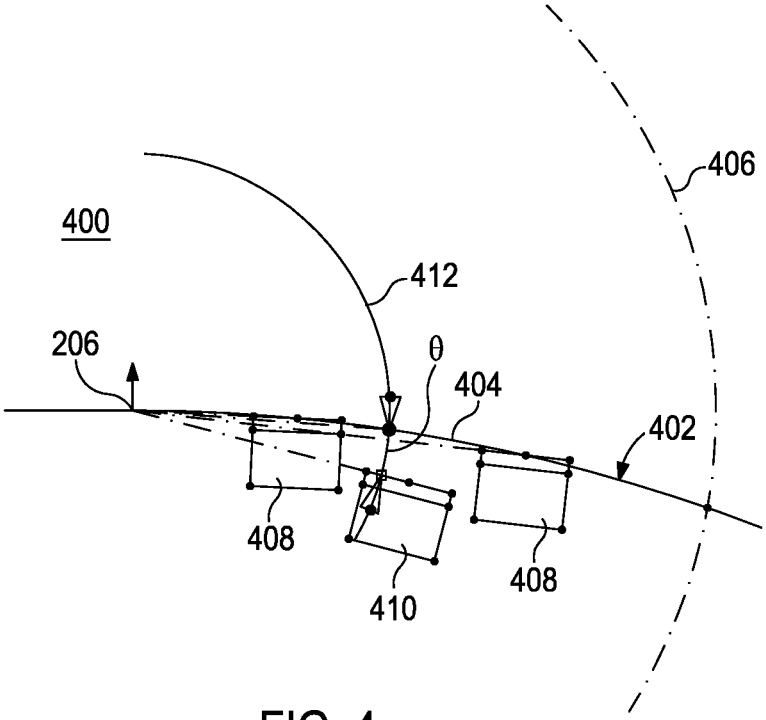
FIG. 4 is a schematic diagram showing example cutter rotation angles in accordance with the principles of the present disclosure.

Referring briefly to FIG. 4, depicted is a schematic diagram 400 showing example cutter rotation angles in accordance with the principles of the present disclosure. More specifically, the schematic diagram 400 depicts an example blade 402 having a leading face 404. The blade 402 may represent either of the primary of secondary blades 204*a,b* of the drill bit 300 of FIG. 3, and thus the leading face 404 may represent any of the leading faces 214 of FIG. 3. As illustrated, the leading face 404 generally follows a smooth, uninterrupted, straight or curved line extending radially outward from the centerline 206 and toward the outer circumference 406 of the bit body.

A plurality of cutters 408 are positioned on the blade 402 and generally arranged side-by-side along the arcuate length of the blade 402. The cutters 408 may represent the primary cutters 212 of FIG. 3 and, as illustrated, the cutters 408 and their cutting faces align with (along) the leading face 404 of the blade 402. As illustrated, at least one of the cutters mounted to the blade 402 comprises an offset cutter 410 that is angularly offset from at least one laterally adjacent primary cutter 408 on the blade 402. In the illustrated embodiment, the offset cutter 410 comprises a recessed offset cutter that is angularly offset from the adjacent primary cutters 408. In other embodiments, however, the offset cutter 410 could alternatively comprise an advanced cutter, as discussed in more detail below.

As used herein, the term "angularly offset" refers to the position of a cutter (e.g., the offset cutter 410) on the blade 402 relative to the position of a laterally adjacent cutter (e.g., the cutter 408) on the same blade 402 as taken from the bit rotational axis or centerline 206. More specifically, the leading face 404 of the blade 402 generally follows a straight or curved line extending from the centerline 206, and the cutting face (e.g., cutter table) of one or more cutters 408 mounted to the blade 402 is arranged flush with the leading face 404. The cutting face of the offset cutter 410, however, is angularly offset from the leading face 404 by an offset angle Θ extending from the centerline 206.

In some embodiments, the offset angle Θ may be at least 5°, but could be as much as 25°. In some embodiments, the offset cutter 410 may also be positioned such that its cutter face is arranged perpendicular to a cutting rotation path 412 corresponding to the position of the offset cutter 410 on the blade 402. Consequently, the cutter face may be positioned normal to the shear direction of the drill bit.

Figure 5:
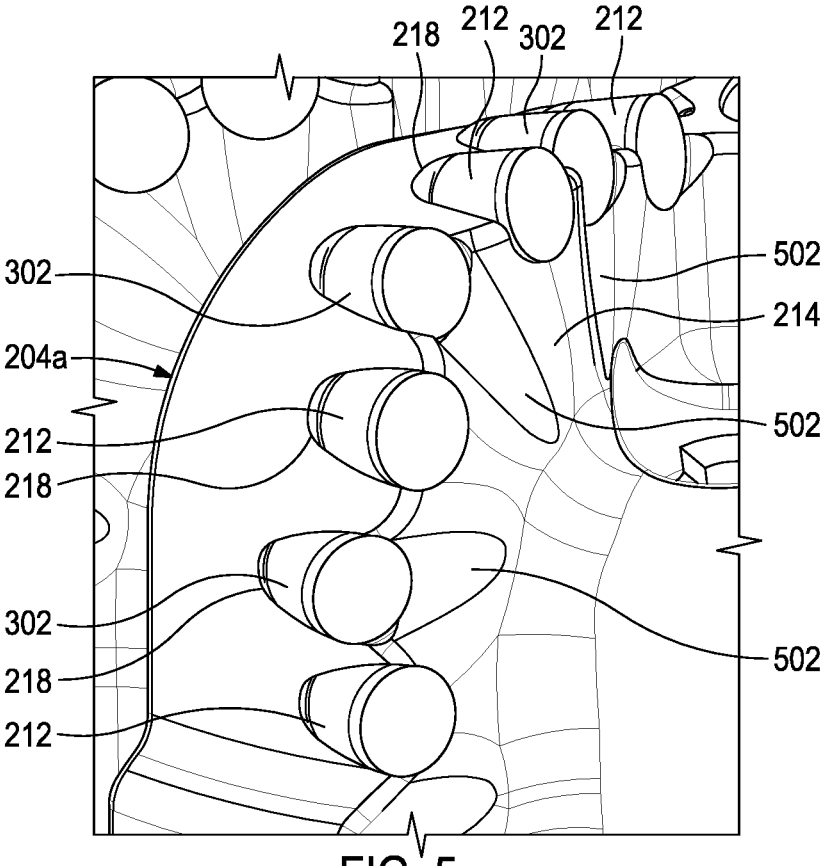
FIG. 5 is an enlarged view of a primary blade of the drill bit of FIG. 3, according to one or more embodiments.

FIG. 5 is an enlarged view of an example primary blade 204*a* of the drill bit 300 of FIG. 3, according to one or more embodiments. While the following discussion is directed to the primary blade 204*a*, the concepts and principles described may be equally or alternatively applicable to the secondary blades 204*b* (FIG. 3). As illustrated, a plurality of primary cutters 212 and recessed offset cutters 302 are positioned on the primary blade 204*a* and received within corresponding pockets 218. In some embodiments, as illustrated, the primary and recessed offset cutters 212, 302 may alternate one-to-one along the arcuate length of the primary blade 204*a*. In other embodiments, however, the placement of the primary and recessed offset cutters 212, 302 may follow other patterns or configurations, depending on bit design and desired drilling performance. For instance, the placement pattern of the primary and recessed offset cutters 212, 302 along the arcuate length of the primary blade 204*a* may be repeating or non-repeating, without departing from the scope of the disclosure.

In some embodiments, as illustrated, the leading face 214 of the primary blade 204*a* may not define a smooth, planar, continuous curve, or uninterrupted surface, but may instead comprise an undulating or non-planar surface accounting for the angular offset positions of the recessed offset cutters 302. In one or more embodiments, for example, an arcuate channel 502 may be defined in the leading face 214 at the location of each recessed offset cutter 302. The channels 502 may prove advantageous in improving hydraulic performance of the drill bit (e.g., the drill bit 300 of FIG. 3) within the junk slots 208. More particularly, the channels 502 may help remove (evacuate) ribbons formed within the junk slots 208 during drilling, and thereby maximize the volume of failed materials that can be processed (flushed) through the junk slots 218.

Figure 6:
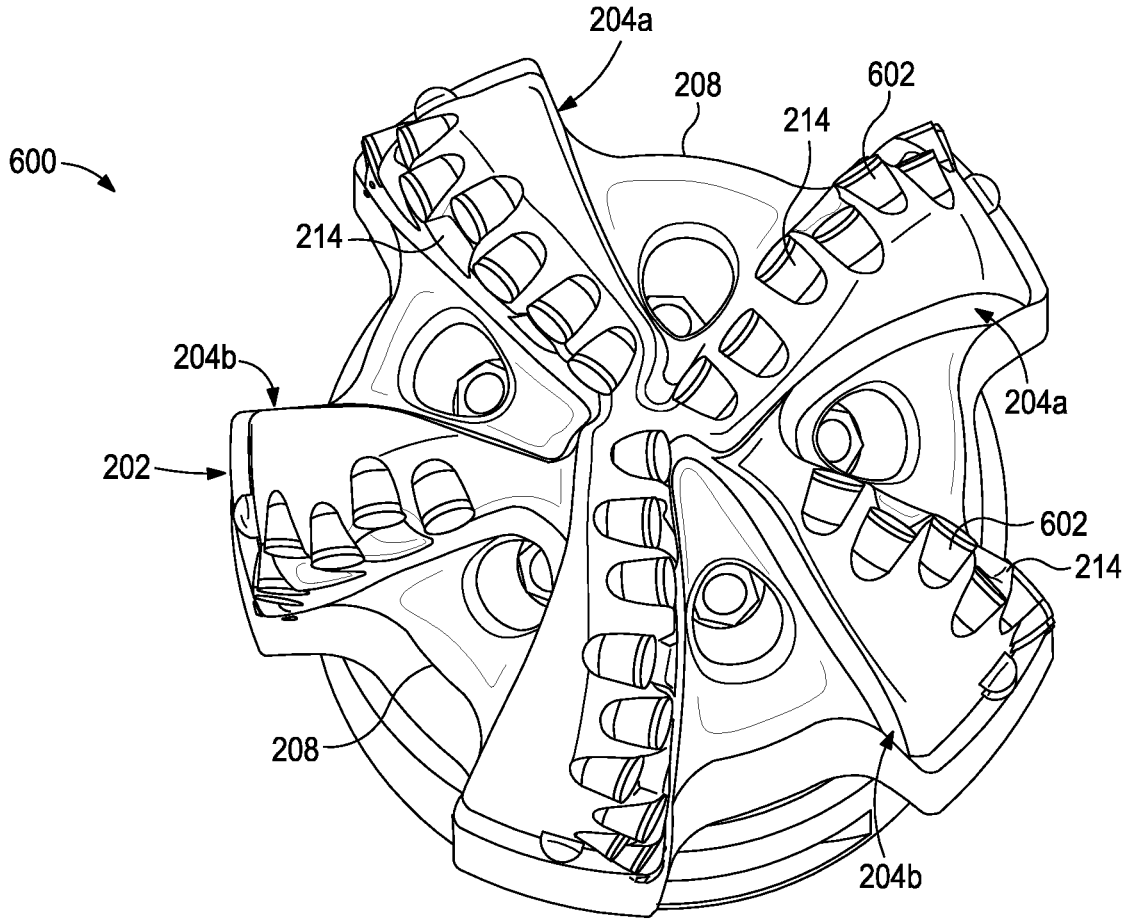
FIG. 6 is a top view of another example drill bit that may incorporate the principles of the present disclosure.

FIG. 6 is a top view of another example drill bit 600 that may incorporate the principles of the present disclosure. The drill bit 600 may be similar in some respects to the drill bit 300 of FIG. 3, and therefore may be best understood with reference thereto, where like numerals correspond to like components not described again. Similar to the drill bit 300, for example, the drill bit 600 includes the bit body 202, which includes the primary and secondary blades 204*a,b* separated by the junk slots 208. In at least one embodiment, however, the secondary blade(s) 204*b* may be omitted, without departing from the scope of the disclosure.

Unlike the drill bit 200 of FIG. 2, however, the drill bit 600 may include one or more advanced offset cutters 602 mounted to either of the primary or secondary blades 204*a,b*. Similar to the recessed offset cutters 302 (FIG. 3), the advanced offset cutters 602 may be angularly offset from laterally adjacent cutters positioned on the same blade. Unlike the recessed offset cutters 302, however, the cutter faces of the advanced offset cutters 602 may be arranged angularly in front of (e.g., in the direction of bit rotation) laterally adjacent cutters on the same blade and extend past (beyond) the leading face 214 of the blade 204*a,b*. Consequently, the cutting faces of the advanced offset cutters 602 may not align with the cutting faces of laterally adjacent cutters along the leading face 214 of the blades 204*a,b*, but may instead be angularly offset and otherwise in front of laterally adjacent cutters.

Figure 7:
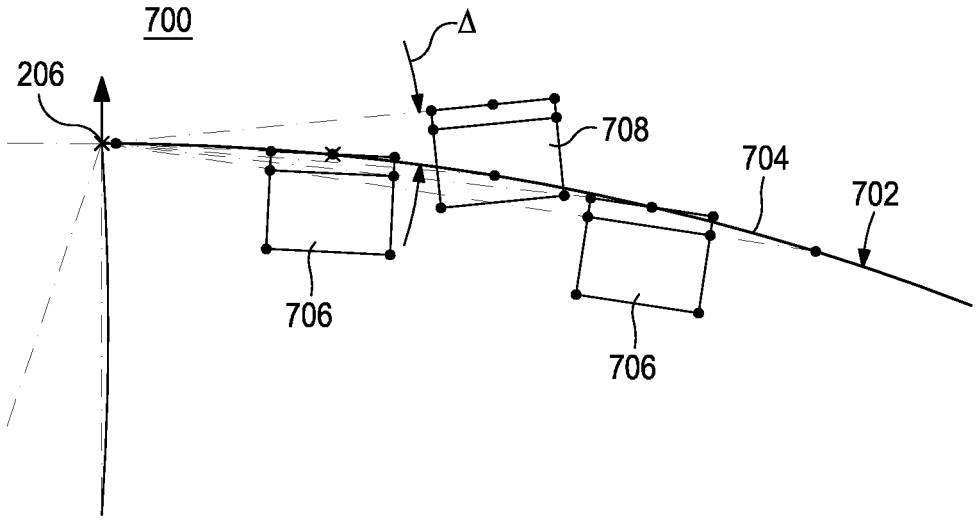
FIG. 7 is another schematic diagram showing example cutter rotation angles in accordance with the principles of the present disclosure.

Referring briefly to FIG. 7, depicted is a schematic diagram 700 showing example cutter rotation angles in accordance with the principles of the present disclosure. More specifically, the schematic diagram 700 depicts an example blade 702 having a leading face 704. The blade 702 may represent either of the primary of secondary blades 204*a,b* of the drill bit 600 of FIG. 6, and thus the leading face 704 may represent any of the leading faces 214 of FIG. 3. As illustrated, the leading face 704 generally follows a smooth, uninterrupted, straight or curved line extending radially outward from the centerline 206 and toward an outer circumference of the bit body.

A plurality of cutters 706 are positioned on the blade 702 and generally arranged side-by-side along the arcuate length of the blade 702. The cutters 706 may represent the primary cutters 212 of FIG. 6 and, as illustrated, the cutters 706 and their cutting faces align with (along) the leading face 704 of the blade 702. As illustrated, at least one of the cutters mounted to the blade 702 comprises an offset cutter 708 that is angularly offset from at least one laterally adjacent primary cutter 706 on the blade 702. In the illustrated embodiment, the offset cutter 708 comprises an advanced offset cutter that is angularly offset from the adjacent primary cutters 706. Accordingly, the advanced offset cutter 708 is arranged angularly in front of (e.g., in the direction of bit rotation) the laterally adjacent cutters 706.

The cutting face of the offset cutter 708 is angularly offset from the leading face 704 by an offset angle A extending from the centerline 206. In some embodiments, the offset angle A may be at least 5°, but could be as much as 25°. In some embodiments, the offset cutter 708 may also be positioned such that its cutter face is arranged perpendicular to the cutting rotation path 412 (FIG. 4) corresponding to the position of the offset cutter 708 on the blade 702. Consequently, the cutter face may be positioned normal to the shear direction of the drill bit.

Angularly offsetting one or more cutters from laterally adjacent cutters by the offset angle Θ (FIG. 4) may provide significant benefits. When placing cutters along a blade, for example, the designer (bit manufacturer) has to be aware of how close the back of each cutter is to adjacent cutters on the same blade as manufacturing restrictions and tolerances require the cutter pockets to be at a minimum distance from each other. When the cutter is angularly offset from adjacent cutters, however, it moves the back of the cutter further away from the back of the pockets of the laterally adjacent cutters. This allows the manufacturer to reduce the spacing between adjacent cutters from the centerline and, therefore, more tightly pack the cutters along the arcuate length of the corresponding blade, which lowers the workload of the cutters. This method of angularly offsetting the cutters can be done to all cutters or only a few cutters in a strategic blade location to accomplish a specific goal.

Accordingly, angularly offsetting one or more cutters on a given blade may result in tighter cutter spacing such that cutters can be placed closer together in relation to their radial distance to center. The closer the cutters are, the smaller their cut shape is, which translates into lower total volume of rock cut by those cutters. This results in the ability to accommodate more cutters into a given profile or strategically use this feature to reduce workload in an area of the bit that commonly sees excessive wear. This also results in tightened cutter spacing as the cutters can be packed closer to each other as extending from the bit centerline. Cutters can be brought radially closer together without running into clearance issues between adjacent cutters.

Angularly offsetting cutters from laterally adjacent cutters may also result in reduced work rate gradients. Reducing or eliminating spikes in the work rate ensures more uniform wear and forces/work rate across the cutters. Uniform wear significantly increases bit life and reduces the likelihood of damage beyond repair. This also helps to reduce repair cost, by lowering the damage beyond repair rate, lowering the likelihood of catastrophic cutter failure, and reducing wear.

Angularly offsetting cutters from laterally adjacent cutters may also result in increasing tool face control when sliding. Tighter cutter spacing in the cone of the drill bit, for example, can significantly reduce torque fluctuation, which, in turn, increases tool face control, or the ability for the directional driller to control the direction the drill bit is going when steering.

Angularly offsetting cutters from laterally adjacent cutters may also result in increased stability of the drill bit. By staggering the angular spacing of the cutters along a given blade, the blade is effectively provided with a "wider stance" because the points of contact are spread out. The wider the stance between adjacent cutters, the more stable the drill bit may be.

Angularly offsetting cutters from laterally adjacent cutters may also result in increased lateral force manipulation. By adjusting the angular location of the cutters, the direction of the forces acting on the bit may also be changed. This results in more freedom to place the cutters such that the resultant lateral forces acting on the bit come closer to zero. The closer the lateral forces of the drill bit are to zero, the more forces are directed in the axial direction (downhole). However, as will be appreciated, there could also be applications where more lateral forces are desirable, and the principles of the present disclosure may help achieve that scenario as well.

As briefly mentioned above, angularly offsetting cutters from laterally adjacent cutters may also result in improved hydraulics and hydraulic performance. More specifically, this may result in reduced fluid velocities around the cutters, which can protect from erosive effects of high velocity drilling fluids. Angularly offsetting the cutter face from the blade face can reduce fluid velocity at that location, and pushing the cutter back from the blade face will protect the recessed offset cutter from the higher fluid velocities.

Angularly offsetting cutters from laterally adjacent cutters may also result in smoother secondary blade transitions. Work rate gradients can be reduced (i.e., smooth work rate curve) in secondary blade transitions by independently adjusting cutters radial forward such that the work done by the radial inward cutter is reduced.

Figure 8:
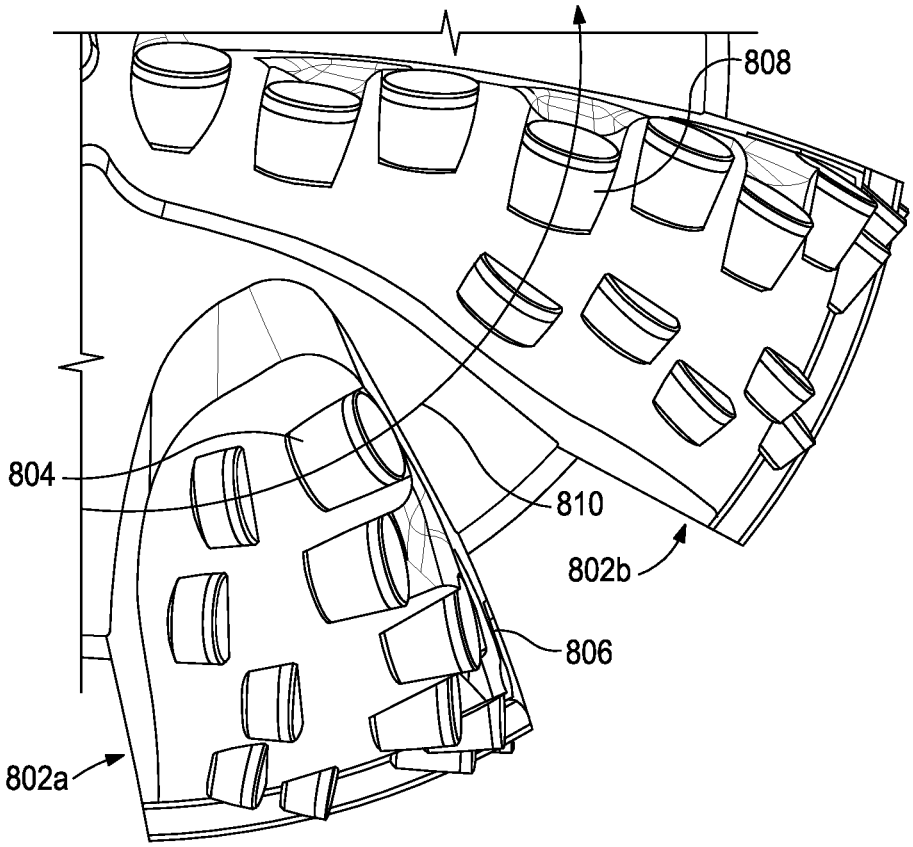
FIG. 8 is an enlarged view of a portion of another example drill bit, which may incorporate one or more principles of the present disclosure.

FIG. 8 is an enlarged view of a portion of another example drill bit 800, which may incorporate one or more principles of the present disclosure. In the illustrated embodiment, the drill bit 800 includes at least two blades 802*a* and 802*b* that are disposed about a centerline of the bit body. The first blade 802*a* may include at least one primary cutter 804 mounted at a leading face 806 of the first blade 802*a*. The second blade 802*b* may include an offset cutter 808 mounted to the second blade 802*b* and angularly offset from the primary cutter 804 arranged on the first blade 802*a* and in the rotation direction of the drill bit 800. In the illustrated embodiment, the offset cutter 808 comprises a recessed offset cutter that angularly precedes the primary cutter 804 in the same angular cutter path 810. In other embodiments, however, the offset cutter 808 may comprise an advanced offset cutter. In even further embodiments, the offset cutter 808 may be mounted to the first blade 802*a* and the primary cutter 804 may be mounted to second blade 802*b*. In such embodiments, the offset cutter 808 may angularly trail the primary cutter 804 in the same angular cutter path 810. Accordingly, the first and second cutters may be considered angularly offset from each other while being secured to discrete blades, but generally following the same cutter path 810.

Moreover, in this embodiment, the offset cutter may be angularly offset from a leading face of the second blade. In some embodiments, for example, the offset cutter may comprise a recessed offset cutter that is angularly offset and positioned behind the leading face of the second blade. In such embodiments, the angular distance between the primary cutter and the offset cutter may be increased in the radial direction. In other embodiments, however, the offset cutter may comprise a recessed offset cutter that is angularly offset and positioned in front of the leading face of the second blade. In such embodiments, the angular distance between the primary cutter and the offset cutter may be decreased in the radial direction.

Embodiments disclosed herein include:

A. A drill bit that includes a bit body providing a plurality of blades disposed about a centerline of the bit body, one or more primary cutters mounted at a leading face of each blade, and one or more offset cutters mounted to at least one of the plurality of blades and angularly offset from a laterally adjacent primary cutter and the leading face of the at least one of the plurality of blades.

B. A drill bit that includes a bit body providing a first blade and a second blade disposed about a centerline of the bit body, the second blade being angularly offset from the first blade about a circumference of the bit body, a primary cutter mounted at a leading face of the first blade, and an offset cutter mounted to the second blade and angularly offset from a leading face of the second blade.

C. A method of drilling a wellbore includes the steps of lowering a drill string into the wellbore, the drill string having a drill bit arranged at a distal end thereof and including a bit body providing a plurality of blades disposed about a centerline of the bit body, one or more primary cutters mounted at a leading face of each blade, and one or more offset cutters mounted to at least one of the plurality of blades and angularly offset from a laterally adjacent primary cutter and the leading face of the at least one of the plurality of blades. The method further including the step of rotating the drill bit and thereby extending a depth of the wellbore.

Each of embodiments A, B, and C may have one or more of the following additional elements in any combination: Element 1: wherein at least one of the one or more offset cutters comprises a recessed offset cutter positioned angularly behind the laterally adjacent primary cutter and the leading face of the at least one of the plurality of blades. Element 2: wherein at least one of the one or more offset cutters comprises an advanced cutter positioned angularly in front of the laterally adjacent cutter and the leading face of the at least one of the plurality of blades. Element 3: wherein a cutting face of the one or more offset cutters is arranged perpendicular to a cutting rotation path corresponding to a position of the one or more offset cutters on the at least one of the plurality of blades. Element 4: wherein a cutting face of the one or more offset cutters is angularly offset from the leading face by an offset angle ranging between about 5° and about 25°. Element 5: further comprising a channel defined in the leading face at a location of at least one of the one or more offset cutters. Element 6: wherein the leading face defines a non-planar or undulating surface. Element 7: wherein the plurality of blades comprise a plurality of primary blades, and the one or more offset cutters comprise one or more offset primary cutters mounted to the plurality of primary blades, the drill bit further comprising one or more secondary blades disposed about the centerline of the bit body, a plurality of back-up cutters mounted at a leading face of each secondary blade, and one or more offset back-up cutters mounted to at least one of the one or more secondary blades and angularly offset from a laterally adjacent back-up cutter and a leading face of the at least one of the one or more secondary blades. Element 8: wherein at least one of the plurality of offset back-up cutters comprises a recessed back-up cutter positioned angularly behind the laterally adjacent back-up cutter and the leading face of the at least one of the one or more secondary blades. Element 9: wherein at least one of the plurality of offset primary cutters comprises an advanced primary cutter positioned angularly in front of the laterally adjacent cutter and the leading face of the at least one of the one or more secondary blades.

Element 10: wherein the offset cutter comprises a recessed offset cutter positioned angularly behind the leading face of the second blade. Element 11: wherein the offset cutter comprises an advanced cutter positioned angularly in front of the leading face of the second blade. Element 12: further comprising a channel defined in the leading face of the second blade at a location of the offset cutter. Element 13: wherein the leading face of the second blade defines a non-planar or undulating surface. Element 14: wherein the offset cutter angularly trails the primary cutter in a same cutter path. Element 15: wherein a cutting face of the offset cutter is arranged perpendicular to a cutting rotation path corresponding to a position of the offset cutter on the second blade. Element 16: wherein a cutting face of the offset cutter is angularly offset from the leading face of the second blade by an offset angle ranging between about 5° and about 25°. Element 17: further comprising one or more offset cutters mounted to the first blade and angularly offset the primary cutter and the leading face of the first blade.

By way of non-limiting example, exemplary combinations applicable to A, B, and C include: Element 7 with Element 8; and Element 7 with Element 9.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

The use of directional terms such as above, below, upper, lower, upward, downward, left, right, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well.

What is claimed is:

1. A drill bit, comprising:

a bit body providing a blade disposed about a centerline of the bit body;

first and second primary cutters mounted at a leading face of the blade such that a cutting face of each primary cutter aligns with the leading face; and two or more offset cutters mounted to the blade and arranged laterally adjacent to respective primary cutters of the first and second primary cutters, the two or more offset cutters being angularly offset from the first and second primary cutters such that a cutting face of the two or more offset cutters is misaligned with the cutting face of the first and second primary cutters, and such that the leading face of the blade undulates at a location of each offset cutter, wherein each offset cutter has a planar cutting face that is arranged perpendicular to a cutting rotation path of the corresponding offset cutter as the bit body rotates, and wherein a discrete channel is defined in the leading face at the location of each offset cutter, and the cutting face of each offset cutter resides within the corresponding discrete channel.

2. The drill bit of claim 1, wherein each offset cutter comprises a recessed offset cutter positioned angularly behind the first and second primary cutters and the leading face of the blade.

3. The drill bit of claim 1, wherein the cutting face of the offset cutter is angularly offset from the leading face by an offset angle ranging between about 5° and about 25°.

4. The drill bit of claim 1, wherein the blade comprises a primary blade, the drill bit further comprising:

a secondary blade disposed about the centerline of the bit body;

first and second back-up cutters mounted at a leading face of the secondary blade such that a cutting face of each back-up cutter aligns with the leading face of the secondary blade; and an offset back-up cutter mounted to the secondary blade and laterally interposing the first and second back-up cutters, the offset back-up cutter being angularly offset from the first and second back-up cutters such that a cutting face of the back-up offset cutter is misaligned with the cutting face of the first and second back-up cutters, and such that the leading face of the secondary blade undulates at a location of the offset back-up cutter.

5. The drill bit of claim 4, wherein the offset back-up cutter comprises a recessed back-up cutter positioned angularly behind the first and second back-up cutters and the leading face of the secondary blade.

6. The drill bit of claim 4, wherein the offset back-up cutter comprises an advanced offset back-up cutter positioned angularly in front of the first and second back-up cutters and the leading face of the secondary blade.

7. The drill bit of claim 1, wherein each discrete channel extends from and below the cutting face of the corresponding offset cutter.

8. The drill bit of claim 1, wherein the offset cutter is a first offset cutter comprising a recessed offset cutter positioned angularly behind the first and second primary cutters and the leading face of the blade, the drill bit further comprising:

a second offset cutter mounted to the blade and comprising an advanced offset cutter positioned angularly in front of laterally adjacent cutters and the leading face of the blade such that a cutting face of the second offset cutter is misaligned with the cutting face of the first and second primary cutters, and such that the leading face of the blade undulates at a location of the second offset cutter.

9. The drill bit of claim 1, wherein a width of each discrete channel is limited to a size of the cutting face the corresponding offset cutter.

10. The drill bit of claim 1, wherein each discrete channel tapers as it extends from the cutting face the corresponding offset cutter.

11. A drill bit, comprising:

a bit body providing a first blade and a second blade disposed about a centerline of the bit body, the second blade being angularly offset from the first blade about a circumference of the bit body;

a primary cutter mounted at a leading face of the first blade such that a cutting face of the primary cutter aligns with the leading face; and two or more offset cutters mounted to the second blade such that one of the two or more offset cutters angularly trails the primary cutter in a same cutter path, the two or more offset cutters being angularly offset from a leading face of the second blade such that a cutting face of the two or more offset cutters is misaligned with the leading face of the second blade, and such that the leading face of the second blade undulates at a location of each offset cutter, wherein each offset cutter has a planar cutting face that is arranged perpendicular to a cutting rotation path of the corresponding offset cutter as the bit body rotates, and wherein a discrete channel is defined in the leading face at the location of each offset cutter, and the cutting face of each offset cutter resides within the corresponding discrete channel.

12. The drill bit of claim 11, wherein each offset cutter comprises a recessed offset cutter positioned angularly behind the leading face of the second blade.

13. The drill bit of claim 11, wherein a cutting face of at least one of the two or more offset cutters is angularly offset from the leading face of the second blade by an offset angle ranging between about 5° and about 25°.

14. The drill bit of claim 11, further comprising one or more additional offset cutters mounted to the first blade and angularly offset from the primary cutter and the leading face of the first blade.

15. The drill bit of claim 11, wherein each discrete channel extends from and below the cutting face of the corresponding offset cutter.

16. The drill bit of claim 11, further comprising a back-up cutter mounted to the first blade angularly trailing the primary cutter in the same cutter path, the back-up cutter angularly interposing the primary cutter and the offset cutter.

17. A method of drilling a wellbore, comprising:

lowering a drill string into the wellbore, the drill string having a drill bit arranged at a distal end thereof and including:

a bit body providing a blade disposed about a centerline of the bit body;

first and second primary cutters mounted at a leading face of the blade such that a cutting face of each primary cutter aligns with the leading face; and two or more offset cutters mounted to the blade and arranged laterally adjacent to respective primary cutters of the first and second primary cutters, the two or more offset cutters being angularly offset from the first and second primary cutters such that a cutting face of the two or more offset cutters is misaligned with the cutting face of the first and second primary cutters, and such that the leading face of the blade undulates at a location of each offset cutter; and rotating the drill bit and thereby extending a depth of the wellbore, wherein each offset cutter has a planar cutting face that is arranged perpendicular to a cutting rotation path of the corresponding offset cutter as the bit body rotates, and wherein a discrete channel is defined in the leading face at the location of each offset cutter, and the cutting face of each offset cutter resides within the corresponding discrete channel.

* * * * *